US005186543A

United States Patent [19]

Cochran

[11] Patent Number: 5,186,543

[45] Date of Patent: Feb. 16, 1993

[54] TEAR-OPEN BAG HAVING GUIDE STRIPS

[75] Inventor: Gene A. Cochran, Midland, Mich.

[73] Assignee: Illinois Tool Works Inc., Glenview, Ill.

[21] Appl. No.: 887,230

[22] Filed: May 19, 1992

Related U.S. Application Data

[63] Continuation of Ser. No. 663,568, Mar. 4, 1991, abandoned.

[51] Int. Cl.[5] ..... B65D 33/02; B65D 33/16

[52] U.S. Cl. ..... 383/203; 383/61; 383/63; 383/81; 383/206

[58] Field of Search ..... 383/61, 63, 78, 81, 383/93, 205, 206, 203; 229/309-312

[56] References Cited

U.S. PATENT DOCUMENTS

| | | | |
|---|---|---|---|
| 3,054,551 | 9/1962 | Holbrook et al. | 206/618 |
| 3,094,269 | 6/1963 | Schneider | 206/618 |
| 3,198,228 | 8/1965 | Naito | 150/3 |
| 3,226,787 | 1/1966 | Ausnit | 383/61 |
| 3,323,707 | 6/1967 | King | 229/66 |
| 3,371,696 | 3/1968 | Ausnit . | |
| 3,473,589 | 10/1969 | Gotz | 150/3 |
| 3,543,343 | 12/1970 | Staller et al. | 18/14 |
| 3,619,395 | 11/1971 | Skendzic | 383/61 |
| 3,780,781 | 12/1973 | Uramoto | 150/3 |
| 3,827,472 | 8/1974 | Uramoto | 150/3 |
| 4,301,925 | 11/1981 | Bogart | 206/616 |
| 4,795,035 | 1/1989 | Kim | 206/618 |
| 4,812,074 | 3/1989 | Ausnit et al. | 493/213 |
| 4,832,768 | 5/1989 | Takahashi | 383/63 |
| 4,846,585 | 7/1989 | Boeckmann | 383/3 |
| 4,874,257 | 10/1989 | Inagaki | 383/63 |
| 4,927,271 | 5/1990 | Branson | 383/5 |
| 4,966,470 | 10/1990 | Thompson et al. | 383/61 |
| 4,971,454 | 11/1990 | Branson et al. | 383/61 |
| 5,022,530 | 6/1991 | Zieke | 383/61 |

*Primary Examiner*—Stephen P. Garbe

*Attorney, Agent, or Firm*—Dressler, Goldsmith, Shore, Sutker & Milnamow, Ltd.

[57] ABSTRACT

An easy-open container includes guide strips to limit tearing to areas adjacent to the intended line of tearing with a tear strip. The guide strips protect zipper elements and bag walls from distortion or tearing due to deviating tear lines. In a second embodiment, the guide strips are included with one or more tear strips on a membrane which may be attached to a container.

3 Claims, 3 Drawing Sheets

TEAR-OPEN BAG HAVING GUIDE STRIPS

This application is a continuation of application Ser. No. 07/633,568, filed Mar. 4, 1991, now abandoned.

BACKGROUND OF THE INVENTION

The present invention relates to improvements in flexible containers, and in particular, to guide strips for an easy-open container.

Reclosable flexible containers are well-known in the art. Such containers typically comprise a bag-like structure made from a folded web or tube of thermoplastic film material. Thermoplastic sheet or tube having male and female interlocking zipper elements, as is known in the art, is typically folded, severed and sealed along two side edges, and closed with the zipper elements across the bag mouth, as for example in U.S. Pat. Nos. 3,371,696 to Ausnit, and U.S. Pat. No. 3,198,228 to Naito.

Because accessible by their very nature, reclosable flexible containers have further been developed which remain completely sealed across the lips of the bag until used. Tear strips are known, such as shown by Staller et al, U.S. Pat. No. 3,543,343, for tearing across the bag lips. Thus, the container remains completely sealed until the user employs the tear strip to gain access to the mouth of the flexible container.

Of further relevance is Ausnit et al, U.S. Pat. No. 4,812,074, wherein a film containing interlocking zipper elements is sealed to a web of thermoplastic material forming a two-layered area of film and web. Folding the web brings the zipper elements into opposing relationship with the film layer inside and the web layer outside the top edge of the container which results. The film, thus, does not serve alone to seal the edge of the container. The '074 patent further discloses a tear strip located in the film by which both the film and web may be torn to gain access to the bag contents.

While such tear strips allow the container to remain air-tight and tamper-proof until initial use, problems have arisen in their use. Such problems include consumers' inability to tear the thermoplastic film material; the need to use scissors to open the container, obviating the value of the tear strip; and irregular tearing, which compromises zippered portions of the containers. Modifications, such as inclusion of perforations along the tear line, have enhanced the efficacy of tear strips, but eliminate the air-tight and tamper-proof features desired in completely sealing the mouth of such containers.

Another approach to hermetically sealing the mouth opening of flexible containers has been the attachment of separate films or membranes over the mouth of a bag-like structure so that the membrane serves as the top edge of the container. See, for example U.S. Pat. No. 4,874,257 to Inagaki, and U.S. Pat. No. 4,927,271 to Branson. Thereafter, the membrane which forms the seal may be ruptured to gain entry to the bag contents. Access to the container of Inagaki is evidently by cutting since no means for opening the hermetic seal are disclosed. Branson, U.S. Pat. No. 4,971,271, discloses a tamper-evident hood closure which is opened by separating the hood closure from the bag along perforated lines of tearing disposed on both side walls of the hood closure. By virtue of its perforations, however, the tamper-evident hood closure of Branson does not hermetically seal the container.

Accordingly, the need remains for further improvement in the design of tear strips for easy-opening of sealed flexible containers of thermoplastic material.

SUMMARY OF THE INVENTION

The present invention meets that need by providing an improved means for opening sealed flexible containers.

In a first embodiment of the present invention, means for tearing are provided which define an intended line of tearing generally along one edge of a flexible container. The preferred means for tearing of the present invention is a tear strip comprised of raised thermoplastic material, such as a bead of thermoplastic material extruded into, fused onto, or otherwise attached by known means to a surface of the film. The tear strip may also be a raised strip or bead comprised of a composite material including thermoplastics, similarly attached to a surface of the film. In the present invention, irregular tearing of flexible containers is limited by guide strips attached to the film on one or both sides of the tear strip.

As with the tear strip, such guide strips may be comprised of raised thermoplastic material such as a bead of thermoplastic or other composite material, extruded, fused, or otherwise attached by known means to a surface of one or both sides of the flexible container. When opening a container with a tear strip, the tear line may deviate or propagate down a side of the flexible container. Upon encountering the guide strips, however, the tear line will continue generally in the intended direction of tearing, across the bag mouth, to open the bag.

Such guide strips are most useful when used in connection with reclosable flexible containers having first and second interlocking zipper elements. Deviating tear lines made by tear strips are prevented from tearing or distorting the interlocking zipper elements. Once the container is opened, the guide strips may also be used as grip strips to facilitate grasping the bag mouth. Such guide strips may also be used with containers without zippers to protect the integrity of bag walls or side walls, so that tearing does not deviate down the bag walls to spill the contents of the bag. Guide strips further ensure that once the bag is torn open, sufficient film remains at the opening for grasping and handling the bag.

Notches or similar excised areas of the flexible container may be provided proximate to the tear strip, and are most effectively located near the edge of the flexible container and immediately below the tear strip. Notches in the container side seals facilitate initial propagation of the tear line, while sealed excised areas adjacent to or below the tear line urge the tear line to re-propagate from points inward from the edges of the flexible container.

The guide strips are preferably located with the tear strip on the inner or first surface of the flexible container, with at least one guide strip located downward, spaced below the tear strip, on each of the bag walls or side walls of the flexible container. Alternatively, some or all of the guide strips and tear strips may be placed on the outer surface of the bag walls.

In sum, when used in conjunction with reclosable flexible containers the tear strip and guide strips permit completely sealing the contents of the container while providing for easy opening to gain access to the contents. So used, the guide strips limit tearing to first and second areas between the guide strips and the tear strip, and inhibit the line of tearing from compromising the reclosable feature of the flexible container or the container side walls.

In a second embodiment of the present invention, one or more tear strips and first and second guide strips are disposed on a separate membrane which may be used to seal an edge of a bag-like structure to form a sealed, easy-open flexible container. The tear strip(s) and guide strips are made of materials as previously described, and may be attached to the first, inner surface or the second, outer surface of the membrane. First and second areas for tearing the membrane are defined between the tear strip(s) and the first and second guide strips, respectively. The membrane may also include first and second interlocking zipper elements, which are protected by the guide strips. Alternatively, the zipper elements may be placed on the bag structure.

Use of such membranes is particularly advantageous because the membrane may be made of materials having different material properties, tearing properties or thicknesses than the bag-like structure or container to which it attaches. Thus, the tear strip(s) and the guide strips may be made even more effective by membrane material selection, protecting zipper elements and containing the tearing to first and second areas defined between the guide strips and the tear strip(s).

When used, such membranes, with or without zipper elements, may be attached either to the inside or outside surface of the bag-like structure. Preferably, the membrane is folded generally along the tear strip(s), and is attached to a bag structure so that the fold forms an edge of the sealed flexible container which results.

It is therefore an object of the present invention to provide guide strips to limit tearing made by one or more tear strips across the mouth of a sealed bag body, envelope or the like. It is a further object of the present invention that such guide strips protect the integrity of zipper elements disposed on bag walls from deviating tear lines. It is a still further object of the invention to protect the integrity of such bag walls themselves, from deviating tear lines.

Another object of the present invention is to provide membranes having one or more tear strips and guide strips to limit tearing, for use in sealing the opening of a container to form an easy-open container. It is a further object of the present invention for such guide strips to protect the integrity of zipper elements disposed on such membranes, and still further, to inhibit undesired tearing of the membrane by deviating tear lines.

An additional object of the present invention is to provide improved easy-open membranes having one or more tear strips limited with guide strips, where such membranes have material and physical properties which promote desired tearing, and which may be attached to a container, such as a bag-like structure, to form a sealed easy-open container.

DETAILED DESCRIPTION OF THE PREFERRED EMBODIMENT

Figure 2:
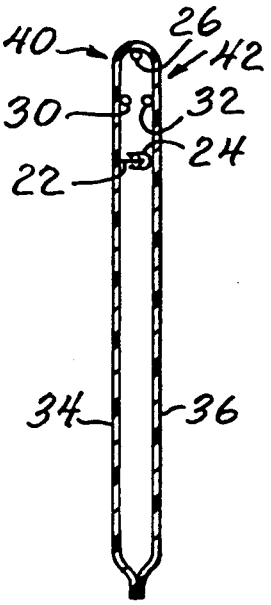
FIG. 2 is a schematic cross-sectional view of the container of FIG. 1 taken along line 2—2.
Figure 1:
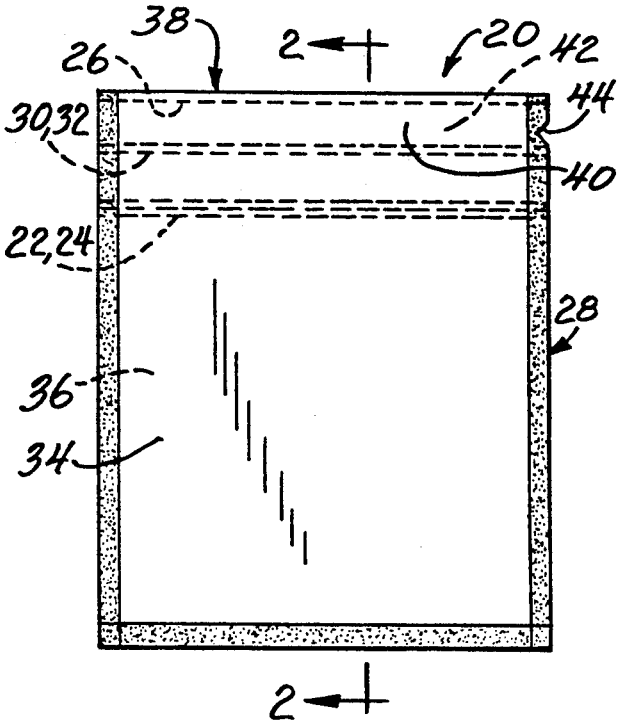
FIG. 1 is a front elevational view of an easy-open flexible container incorporating a tear strip and guide strips of the present invention.

Referring to FIG. 1, an easy-open flexible container 20 is shown having interlocking first and second zipper elements 22, 24, and a tear strip 26. Tear strip 26 is located generally along the top edge 38 of bag body 28. Shown in FIGS. 1 and 2, guide strips 30 and 32 of the present invention are located on first and second bag walls 34 and 36, respectively, between tear strip 26 and zipper elements 22, 24. So located, guide strips 30, 32 define first and second areas 40 and 42, respectively, and limit tearing with tear strip 26 to those areas to protect zipper elements 22, 24 and bag walls 34, 36.

Figure 4:
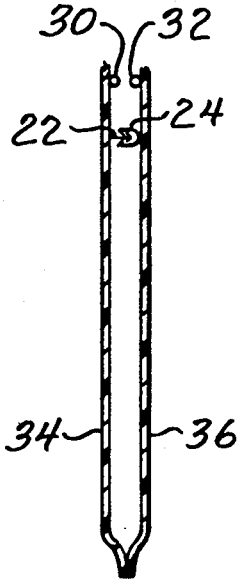
FIG. 4 is a schematic cross-sectional view of the container of FIG. 3 taken along line 4—4.
Figure 3:
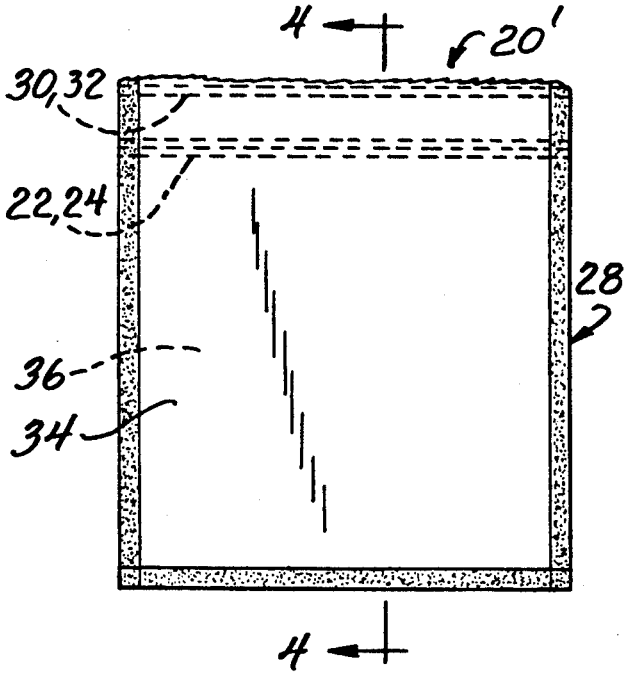
FIG. 3 is a front elevational view of the easy-open flexible container of FIG. 1 after opening with the tear strip, where tearing is limited by the guide strips of the present invention.

As further shown in FIGS. 3 and 4, guide strips 30, 32 promote generally even tearing along the top edges of bag walls 34, 36. As shown, tearing has been confined by guide strips 30, 32 to first and second areas 40, 42, shown in FIG. 1. Guide strips 30, 32 remain on bag walls 34, 36 of open container 20', and continue to serve as grip strips to facilitate grasping the mouth of the bag.

Tear strip 26 is a raised bead or rib comprised of thermoplastic material, such as low density polyethylene (LDPE), or a composite material including thermoplastic. Tear strip 26 is, preferably, fused onto the thermoplastic film of container 20, but may also be extruded with the film, extruded onto the film, or attached by other means known in the art. Guide strips 30, 32 are likewise made of a thermoplastic material, preferably LDPE, or a composite material including thermoplastics. Guide strips 30, 32, are also preferably fused onto a surface of the film, but may also be extruded with or onto, or otherwise attached to a surface of the film of container 20. Zipper elements 22, 24 and sealed bag body 28 are made of materials and attached by means known in the art.

Guide strips 30, 32 and tear strip 26 are all preferably disposed on the inner surface of container 20, but all or some of them could also be positioned on the outer surface of container 20. Such alternative embodiments, representatively shown in FIGS. 9–12, are not preferred.

Figure 14:
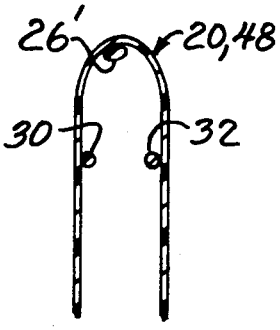
FIG. 14 is a partial schematic cross-sectional view of the one or more tear strips and guide strips of the present invention showing an oval-shaped tear strip.

As shown in FIG. 14, it is preferred to use an oval-shaped tear strip 26' on the inner surface of the container. It has been found that the oval shape of tear strip 26' enhances the tearing action when one of the narrow faces of the oval bead is positioned to engage the inner surface of container 20. By attaching a wide face of oval-shaped tear strip 26' to the surface of container 20, a narrow face of oval-shaped tear strip 26' may be oriented upward when the film is folded. So disposed, the narrow face serves as the leading edge for tearing open the container 20, and its cross-section has a knife-like effect on the film. Preferably, oval-shaped tear strip 26' is attached slightly off-center between zipper elements 22, 24 to facilitate the desired positioning of oval-shaped tear strip 26' as well as to enhance folding of the thermoplastic film forming container 20 or membrane 48.

Guide strips 30, 32 may be used with tear strips 26 in various containers 20, including bag structures (as shown), envelopes, or other containers, which do not include zipper elements 22, 24. Such use protects the integrity of container side walls or bag walls 34, 36 from deviation of the tear line during opening, and promotes controlled tearing along the intended line of tearing, typically a straight line.

Notches 44 or similar excised areas 46 (shown representatively in FIG. 15) may be provided near tear strip 26 to facilitate initial propagation of the tear line and assist in repropagating a deviating tear line, respectively.

In a further embodiment of the present invention, best shown in FIGS. 5–8, where like elements have like numerals, one tear strip(s) 26 and guide strips 30, 32 of the present invention are disposed on a separate membrane 48. Membrane 48 may be used to seal the opening of a container, such as bag-like structure 50, to form a sealed easy-open container 52. Tear strip(s) 26 and guide strips 30, 32 are made of materials and attached by means previously described, and may be attached to the first, inner surface 54 or the second, outer surface 56 of membrane 48. Thus, tear strip(s) 26 is preferably an oval-shaped tear strip 26' of LDPE, positioned and attached to membrane 48 as described above with respect to the first embodiment. Guide strips 30, 32 may be ribs, beads, raised profiles, and the like, made of thermoplastic, preferably LDPE fused onto inner surface 54. Guide strips 30, 32 may also be produced and attached by other known means to a surface of membrane 48. Regardless, guide strips 30, 32 and tear strip 26 define first and second areas 40, 42 for tearing membrane 48.

Figure 6B:
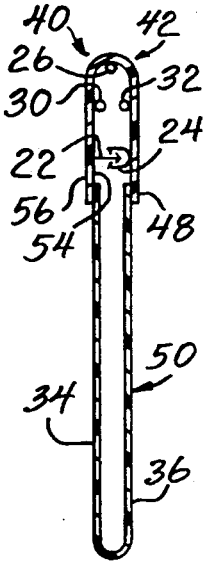
FIG. 6B is a schematic cross-sectional view of the container of FIG. 5 taken along line 5—5, showing a second alternative structure for attachment of the membrane to the bag.
Figure 6A:
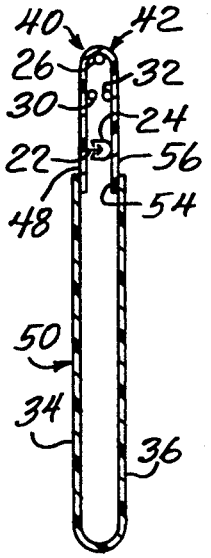
FIG. 6A is a schematic cross-sectional view of the container of FIG. 5 taken along line 5—5, showing a first alternative structure for attachment of the membrane to the bag.
Figure 5:
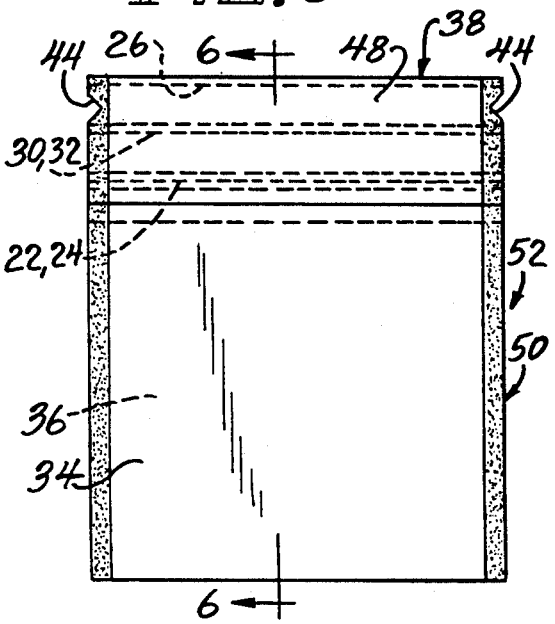
FIG. 5 is a front elevational view of an easy-open container formed by connecting the membrane of the present invention to a bag, where the membrane carries the zipper elements.

As shown in FIGS. 5–6, membrane 48 may include first and second interlocking zipper elements 22, 24, which are protected, in accordance with the present invention, by guide strips 30, 32. Guide strips 30 ,32 protect zipper elements 22, 24 from damage during opening by confining tearing to first and second areas 40, 42. While zipper elements 22, 24 are preferably disposed on the inner surface 54 of membrane 48, as shown in FIGS. 5–6, they may alternatively be placed on the inner surface of bag structure 50, as shown in FIGS. 7–8.

Figure 8B:
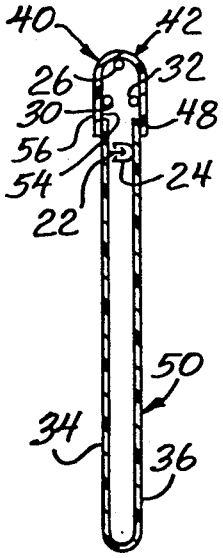
FIG. 8B is a schematic cross-sectional view of the container of FIG. 7 taken along line 8—8, showing a second alternative structure for attachment of the membrane to the bag.
Figure 8A:
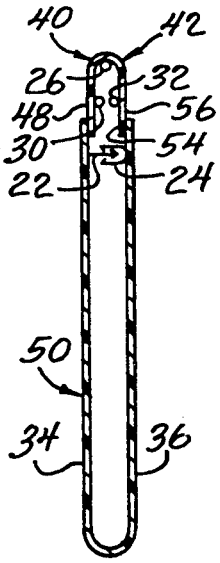
FIG. 8A is a schematic cross-sectional view of the container of FIG. 7 taken along line 8—8, showing a first alternative structure for attachment of the membrane to the bag.
Figure 7:
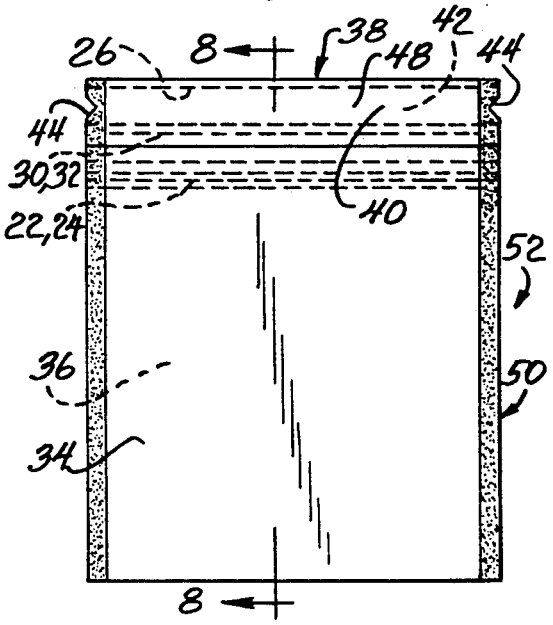
FIG. 7 is a front elevational view of an easy-open container formed by connecting the membrane of the present invention to a bag, where the bag includes zipper elements.

In the embodiment of FIGS. 7–8, guide strips 30, 32 serve to confine tearing to first and second areas 40, 42 protecting the integrity of the bag walls 34, 36. The structure shown in FIGS. 7–8 may be particularly desirable where frangible bag-like or container structures 50 are used, but a positive, easy-open seal is desired.

Membranes 48 may be attached either on their inner surface 54 or outer surface 56 to bag-like structure 50, as shown in FIGS. 6 and 8. Preferably, membrane 48 is folded generally along tear strip 26, and is attached to bag structure 50 so that the fold forms an edge 38 of the sealed flexible container 52 which results. After opening, guide strips 30, 32 serve as grip strips.

It is understood that the bag-like structure 50 or other container to which membrane 48 is attached may be provided without zipper elements 22, 24.

Membranes 48 are particularly advantageous in sealing bag or container structures 50 because materials having different properties may be used. Thus, the tear strip(s) 26 and the guide strips 30, 32 may be made even more effective by membrane material selection, for example, for a different thickness, or enhanced tearability or sealing properties. Protection of the zipper elements 22, 24 and bag walls 34, 36 may thus be enhanced.

Preferably, membrane 48 is comprised of ethylene acrylic acid (EAA) or ethylene vinyl acetate (EVA), which have a low heat melt temperature which facilitates sealing the membrane to opposing bag walls at low temperatures and high speeds. Additionally, the membrane may be a multi-layer film further incorporating materials which provide desirable sealing or manufacturing properties. For example, inner surface 54 could be comprised of high density polyethylene (HDPE) to prevent fusing together opposing surfaces of membrane 48 when sealing outer surface 56 to container 50. A third, middle layer could be added to provide an additional barrier to enhance hermetic sealing with the membrane, comprised for example, of Saran (polyvinylidene chloride), polyamide or ethylene vinyl alcohol (EVOH).

Figure 9:
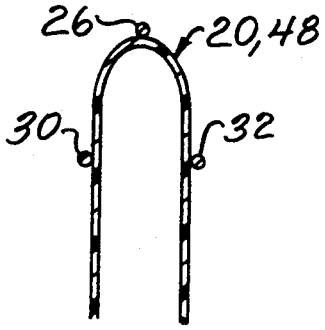
FIGS. 9-13 are partial schematic cross-sectional views of the one or more tear strips and guide strips of the present invention in various alternative embodiments of the containers and membranes shown in FIGS. 1, 5 and 7.
Figure 10:
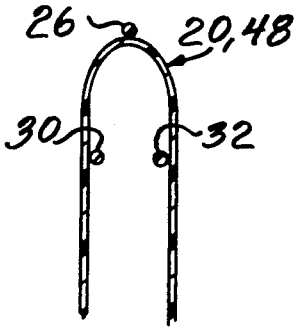
Figure 11:
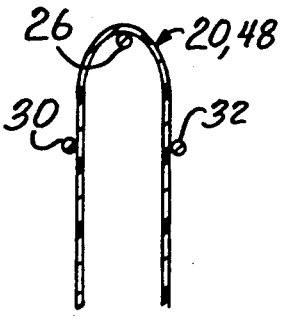
Figure 12:
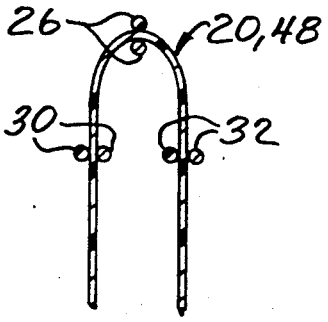
Figure 13:
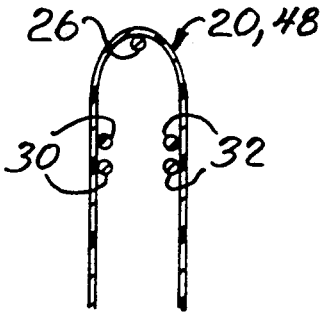
Figure 16:
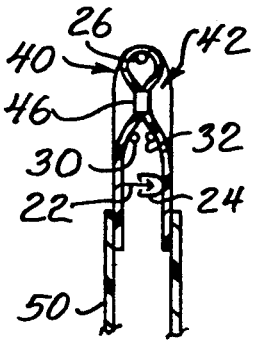
FIG. 16 is a cross-sectional view of the container of FIG. 15 taken along line 15—15.
Figure 15:
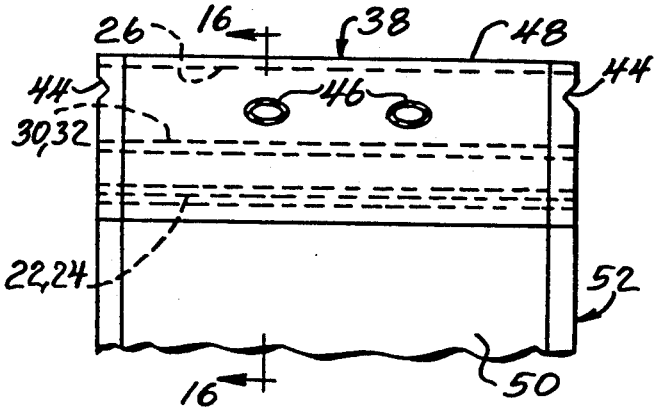
FIG. 15 is a partial front elevational view of an easy-open container formed by connecting the membrane of the present invention to a bag, and the membrane includes excised areas and notches to assist in propagating the tear line.

FIGS. 9–13 and 15–16 show alternative embodiments of the present invention. FIGS. 9–11 representatively show that tear strip 26 and guide strips 30, 32 may be disposed variously on the inner or outer surfaces of membrane 48 or container 20. Similarly, FIGS. 12–13 representatively show that more than one tear strip 26 or guide strips 30, 32 may be included on membrane 48 or container 20. More than one tear strip 26 might be desired, for example, where membrane 48 comprises a thicker material which resists tearing, while more than one guide strip 30 or 32 may be desired, for example, where a safety factor in protecting zipper elements 22, 24 or bag walls 34, 36 is necessary. Finally, FIGS. 15 and 16, representatively show the use of guide strips 30, 32 in cooperation with excised areas 44 and 46 to enhance initial propagation of a tear line, and promote repropagation of a deviating tear line, respectively.

While certain representative embodiments and details have been shown for purposes of illustrating the invention, it will be apparent to those skilled in the art that various changes in the articles disclosed herein may be made without departing from the scope of the invention, which is defined in the appended claims.

What is claimed is:

1. A bag comprising a bag body formed of thermoplastic film having generally opposed walls meeting to form one edge of the bag body and to define an opening of the bag body and a discrete membrane formed of thermoplastic film and sealed to the bag body along the edge of the bag body so as to seal the opening of the bag body and to define an enclosure, said membrane having an inner surface inside the enclosure and an outer surface outside the enclosure, said membrane comprising a tear strip extending along and protruding from the inner surface of the membrane and guide strips extending along and protruding from the inner surface of the membrane in spaced relation to the tear strip, said bag further comprising interlocking first and second zipper elements extending along the inner surface of the membrane in spaced relation to the guide strips, the guide strips being disposed between the zipper elements and the tear strip, each of the tear and guide strips having a height measured from the inner surface of the membrane and a width equal approximately to its height, the guide strips being spaced from the tear strip and from the zipper elements by areas of the thermoplastic film of the membrane which are wider than any of the tear and guide strips, the thermoplastic film of the membrane having a generally uniform thickness between the tear strip and the guide strips and between the guide strips and the zipper elements.

2. The bag of claim 1 wherein the width of each of the tear and guide strips and its height measured from the inner surface of the membrane are equal approximately to the generally uniform film thickness between the tear strip and the guide strips and between the guide strips and the zipper elements.

3. The bag of claim 1 wherein the thermoplastic film of the membrane has a single layer of generally uniform thickness between the tear strip and the guide strips and between the guide strips and the zipper elements.

* * * * *